US007148781B2

(12) United States Patent
Beausoleil

(10) Patent No.: US 7,148,781 B2
(45) Date of Patent: Dec. 12, 2006

(54) LANDSCAPE LIGHTING TRANSFORMER HAVING INCREASED LOADING FEATURES

(76) Inventor: David M. Beausoleil, 337 S. Maple Ave., Ridgewood, NJ (US) 07450

( * ) Notice: Subject to any disclaimer, the term of this patent is extended or adjusted under 35 U.S.C. 154(b) by 0 days.

(21) Appl. No.: 10/964,500

(22) Filed: Oct. 13, 2004

(65) Prior Publication Data

US 2005/0077991 A1 Apr. 14, 2005

Related U.S. Application Data

(60) Provisional application No. 60/481,500, filed on Oct. 13, 2003.

(51) Int. Cl.
*H01F 21/12* (2006.01)

(52) U.S. Cl. ..... 336/150; 336/116; 336/192

(58) Field of Classification Search ..... 336/150, 336/192, 115, 116, 121, 129; 323/340, 255; 315/278; 361/152, 35
See application file for complete search history.

(56) References Cited

U.S. PATENT DOCUMENTS 2,006,997 A * 7/1935 Lingal ..... 361/152
3,395,317 A * 7/1968 Hanson ..... 361/91.6
3,663,828 A 5/1972 Low et al.
3,932,791 A 1/1976 Oswald
4,335,414 A 6/1982 Weber
4,375,077 A 2/1983 Williams
4,541,041 A 9/1985 Park et al.
4,772,978 A 9/1988 Oura et al.
4,951,168 A * 8/1990 Harrison ..... 361/35
5,369,542 A 11/1994 Leone et al.
5,477,113 A * 12/1995 Christoffersson ..... 315/278
5,790,356 A 8/1998 Bottrell et al.
2003/0080847 A1 5/2003 Radzelovage
2003/0156433 A1 8/2003 Gong et al.

* cited by examiner

*Primary Examiner*—Elvin Enad
*Assistant Examiner*—Joselito Baisa
(74) *Attorney, Agent, or Firm*—Catalina and Associates, P.C.; Richard A. Catalina, Jr.; Michael J. Huey

(57) ABSTRACT

A transformer for low-voltage applications such as landscape lighting, comprising a primary winding and a secondary winding inductively coupled to the primary winding, the primary winding adapted to be energized with a high voltage and the secondary winding adapted to carry a proportionately lower voltage, the secondary winding including a plurality of output taps, each output tap corresponding to a specified output voltage, and at least one common tap for each 300 W of output power up to the full capacity of the transformer, the secondary winding further including an additional common tap for an additional 300 W of output power beyond the full capacity of the transformer. A circuit breaker is associated with the primary winding and a circuit breaker is associated with each common tap and the additional common tap.

15 Claims, 3 Drawing Sheets

LANDSCAPE LIGHTING TRANSFORMER HAVING INCREASED LOADING FEATURES

This non-provisional application claims the benefit of U.S. Provisional Application No. 60/481,500, filed Oct. 13, 2003, and entitled "IMPROVED LANDSCAPE LIGHTING TRANSFORMER HAVING INCREASED LOADING FEATURE," hereby incorporated by reference in its entirety.

BACKGROUND OF THE INVENTION

The present invention generally relates to improvements in transformers and, more particularly, to an improved low-voltage transformer for use in landscape lighting applications.

Transformers are well known electrical devices that utilize a primary and secondary winding to provide an output potential from the secondary winding that is higher or lower than the potential of a power source coupled to the primary winding. One particular application for such transformers is in landscape lighting systems, which typically employ low-voltage landscape lighting fixtures. Low voltage landscape lighting systems are safe, economical, energy efficient and provide numerous benefits for modem homeowners. Lighting can be used to provide safe access near paths, drives and entry areas. Outdoor lighting increases security by discouraging potential intruders. And the beauty of garden and home can be dramatically enhanced by showcasing architectural and plant features with dramatic lighting techniques. Low voltage systems have become more and more popular, and offer the advantages of easier cable installation without burdensome conduits, reduced risk of electrical shock and lower power consumption when compared with typical high-wattage 120 volt (V) lamps.

In landscape lighting applications, the primary winding of a landscape lighting transformer is coupled to a 120V power source and the secondary winding is connected to one or more runs of 12V landscape lighting fixtures. Some landscape lighting transformers incorporate a plurality of taps to enable a range of output voltages for different wire runs that require higher voltages to compensate for power losses through the wire runs as a result of excessive wire lengths or to control lamp brightness. In such cases, the transformer may have terminals corresponding to a range of voltages such as, for example, from 12V to 18V. Halogen lamps that are conventionally utilized in such fixtures have an acceptable operating range of between 10.8V to 12V, with an optimal operating range of between 11.0V to 11.5V. As a general industry practice, low-voltage landscape lighting transformers are manufactured with power ratings in multiples of 300 watts (W). To protect the transformer from overload or damage, the secondary winding typically includes one or more circuit-breakers or fuses. In conventional transformers, the primary winding is not protected by a circuit-breaker or fuse, since the circuit-breaker(s) on the secondary winding are usually sufficient to protect the core from overloading.

Prior art transformers suffer a drawback in that the full power capacity of the transformer is typically not accessible. Notably, one major design flaw in a conventional landscape lighting transformer is that, on average, 10–20 percent of the wattage capacity of the transformer is often left unutilized. This is because an installer simply cannot use 100% of the current capacity of the secondary winding. For example, the secondary winding of a 300 W transformer may have a single common tap protected with a 25 amp (A) circuit breaker. In an exemplary application, assume that a given wire run of lamps rated at 90 W each are operating at 12V. Accordingly, each lamp/wire run draws a current of 7.5A in accordance with the well known principle P=iV (e.g., 7.5 A=90 W/12V). Thus, only three lamp/wire runs (which draw a total of 7.5 A×3=22.5 A), can be coupled to the secondary winding because any additional lamp/wire run would draw current in excess of the 25 A breaker limit. Accordingly, using this example, 2.5 A (e.g., 25 A–22.5 A) of unused capacity remains on the common tap, which equates to 30 W of unused power at 12V (e.g., 2.5 A×12V). This amounts to 10% of the transformer's total power capacity. Although 10% may not seem like a significant amount, the greater the power capacity of the transformer, the larger the power capacity that may be left unutilized. Thus, although a customer may have purchased a transformer having a specified power output, such as 300 W, under the scenario discussed above, 30 W of unused power is not accessible and therefore wasted.

Conventional landscape lighting transformers are typically manufactured with power ratings in multiples of 300 W, with associated common taps in multiples of 300 W. In a prior art 1,200 W transformer, therefore, four common taps are provided, one for each 300 W. In a 900 W transformer, three common taps are provided. In a 600 W transformer, 2 common taps are provided. These transformers suffer from drawbacks in that the full power capacity of the transformer can never be realized as explained above. For example, to fully utilize the full 1,200 W of a 1,200 W rated transformer, wire runs that add up to exactly 300 W for each of the four taps would have to be employed. In reality, this never happens as a typical installation will leave unused capacity on each tap. Thus, even though the load of the initial wire runs may only be 900 W, if it is desired to add another run of 200 W, which is still within the overall capacity of the transformer, it may be impossible to do so because of insufficient capacity remaining on any common tap.

In view of the above, there exists a need for an improved transformer that enables an installer of landscape lighting fixtures to take advantage of the full rated capacity of the transformer.

SUMMARY OF INVENTION

In view of the foregoing, it is an object of the present invention to provide a transformer for low-voltage applications that permits increased utilization of the transformer's power capacity in comparison to conventional transformer designs.

It is another object of the present invention to provide a transformer for low-voltage applications that enables wire runs to be connected up to the full capacity of the transformer without overloading any of the common terminals of the transformer.

It is still another object of the present invention to provide a transformer for low-voltage applications that incorporates an additional common terminal to enable wire runs to be connected up to the full capacity of the transformer without overloading any of the common terminals of the transformer.

It is still another object of the present invention to provide a transformer for low-voltage applications that incorporates an additional common terminal as explained above in conjunction with circuit breaker protection on the primary side of the transformer to facilitate the connection of wire runs up to the full capacity of the transformer without overloading any of the common terminals of the transformer.

In accordance with an aspect of the invention, a transformer for low voltage applications is provided, which comprises: a primary winding and a secondary winding inductively coupled to the primary winding, the primary winding adapted to be energized with a high voltage and the secondary winding adapted to carry a proportionately lower voltage. The secondary winding includes a plurality of output taps, each output tap corresponding to a specified output voltage, and at least one common tap for each nW (e.g., 300 W) of output power up to the full capacity of the transformer. The secondary winding further includes an additional common tap for an additional nW (e.g., 300 W) of output power beyond the full capacity of the transformer. To protect the transformer from exceeding its overall rated power, in accordance with another aspect of the invention, a circuit breaker is associated with the primary winding and a circuit breaker is associated with each common tap and the additional common tap.

In accordance with these and other objects that will become apparent hereinafter to those of ordinary skill in the art, the present invention will now be described with particular reference to the accompanying drawings.

DETAILED DESCRIPTION OF THE PREFERRED EMBODIMENTS

Figure 1A:
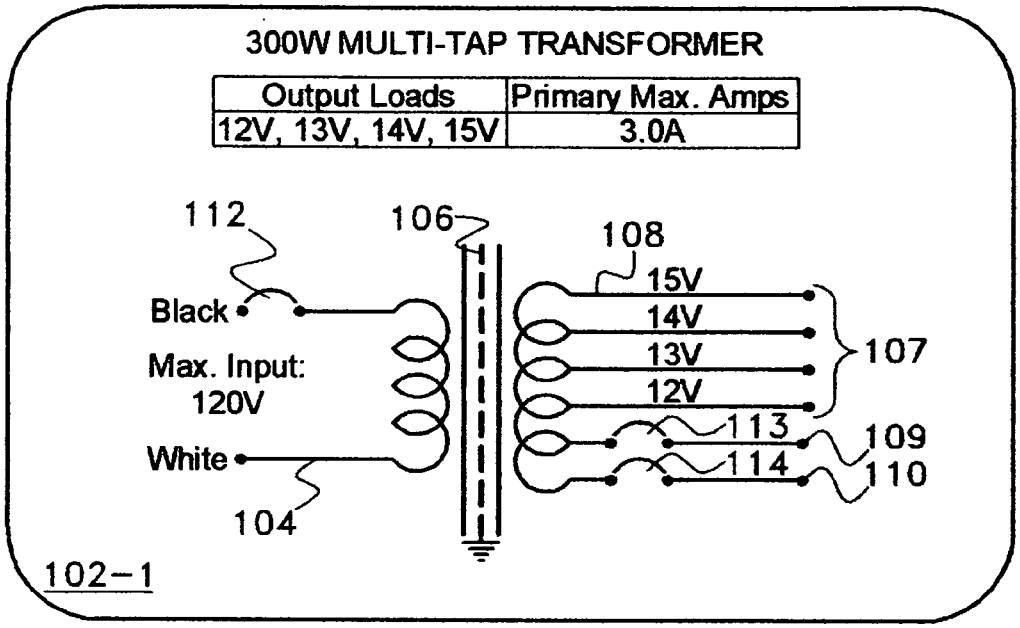
FIG. 1A is a schematic diagram of a 300 W landscape lighting transformer in accordance with the present invention.
Figure 1B:
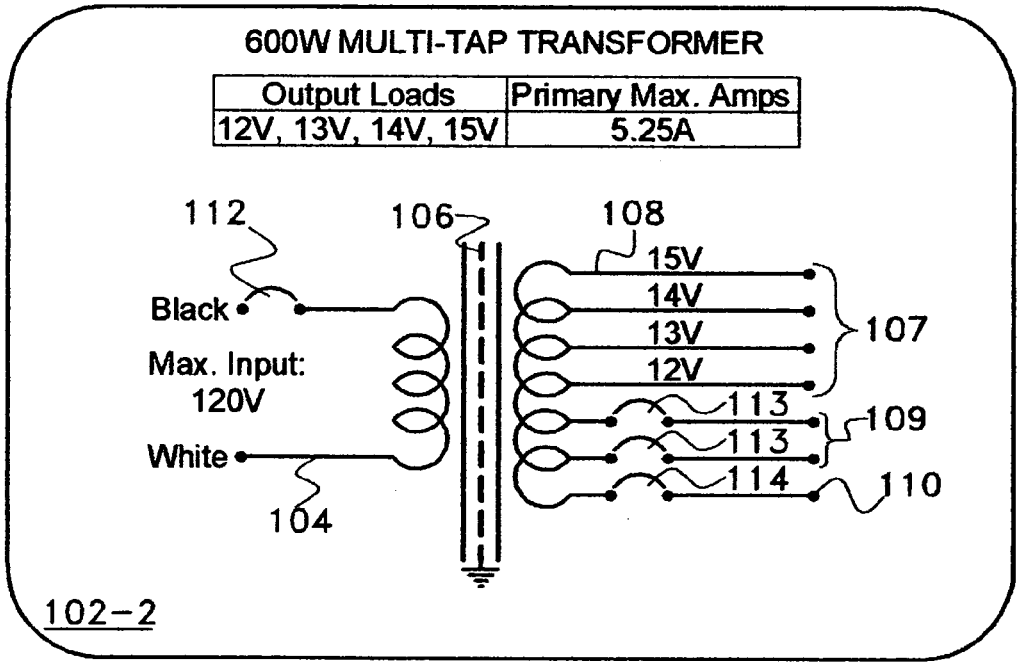
FIG. 1B is a schematic diagram of a 600 W landscape lighting transformer in accordance with the present invention.
Figure 1C:
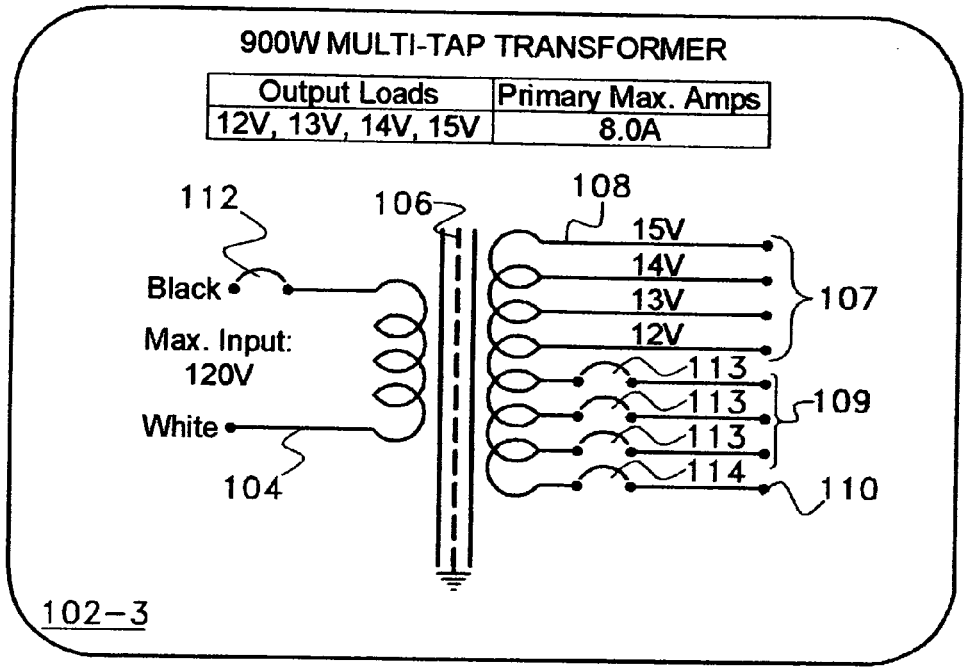
FIG. 1C is a schematic diagram of a 900 W landscape lighting transformer in accordance with the present invention.
Figure 1D:
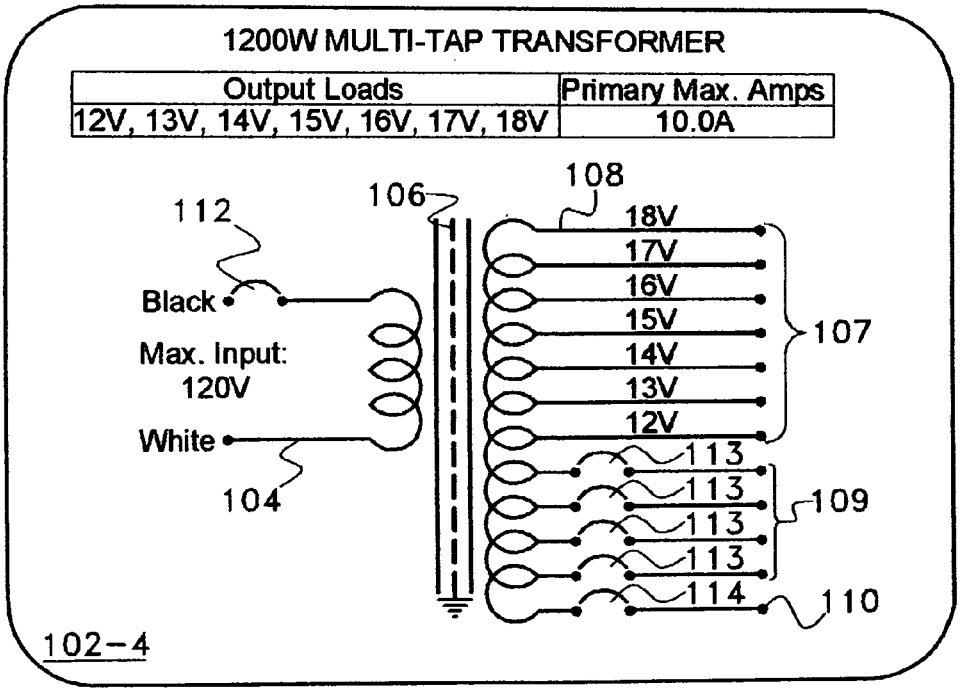
FIG. 1D is a schematic diagram of a 1200 W landscape lighting transformer in accordance with the present invention.
Figure 1E:
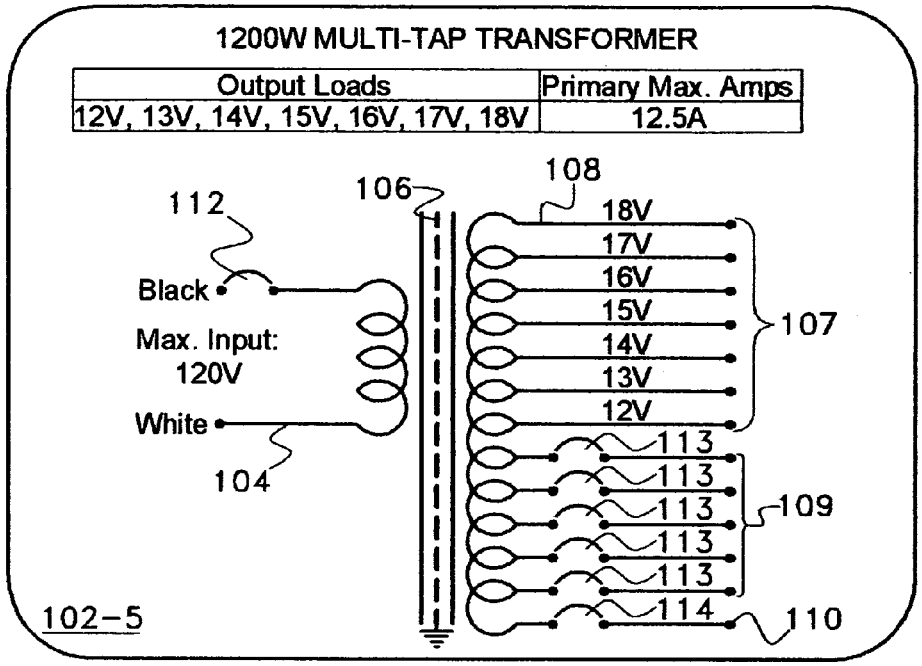
FIG. 1E is a schematic diagram of a 1500 W landscape lighting transformer in accordance with the present invention.

FIGS. 1A–1E are schematic representations of illustrative embodiments of landscape lighting transformers rated at 300 W, 600 W, 900 W, 1200 W and 1500 W, respectively, in accordance with one or more aspects of the invention. As depicted in the drawings, a transformer 102-1 illustratively has a 300 W capacity, a transformer 102-2 illustratively has a 600 W capacity, a transformer 102-3 has a 900 W capacity, a transformer 102-4 illustratively has a 1200 W capacity, and a transformer 102-5 illustratively has a 1500 W capacity. The transformers 102-1 through 102-5 are collectively referred to herein as transformers 102. It will be appreciated by those of ordinary skill in the art, that transformers having other power capacities may be employed in accordance with the principles of the present invention.

Each transformer 102 includes a primary winding or coil 104, a core 106, and a secondary winding or coil 108. The core 106 is formed of EI, ferrous, core metal laminates or may be toroidal. Toroidal cores are preferred for landscape lighting applications as they are small and light weight. A toroidal transformer core 106 is made by a tape-wound strip of electrical steel. The primary 104 and secondary 108 windings are threaded through a central opening in the toroidal core 106 and distributed evenly along the circumference of the core 106. Each transformer 102 comprises one or more standard output taps 107 coupled to the secondary winding 108 for tapping a desired voltage, e.g., 12V, 13V, 14V, etc. In accordance with well-known principles of transformer operation, a high voltage (e.g., 120V) is applied to the primary winding 104. The secondary winding 108 is inductively coupled to the primary winding 104 such that a lower voltage proportional to the number of windings is set up in the secondary winding 108. The secondary winding 108 also has a common tap 109 corresponding to 300 W of power capacity for returning current back to the secondary winding. In low-voltage transformers, common taps 109 are traditionally provided in multiples of 300 W of power capacity. Thus, in the case of a 300 W transformer 102-1, there is one standard common tap 109, for a 600 W transformer 102-2, there are two standard common taps 109, for a 900 W transformer 102-3, there are three standard common taps 109, for a 1200 W transformer 102-4, there are 4 standard common taps 109 and for a 1500 W transformer 102-5, there are 5 standard common taps 109, etc. Each 300 W common tap 109 is protected by a circuit breaker or fuse (e.g., a 25 A circuit-breaker 113 as shown). The circuit breaker 113 described above and the breakers discussed hereinafter are preferably of the magnetic type, but may be any other type of device for breaking an overloaded circuit including a fuse, thermal breaker, or any other device that can clear a short or overload, within the scope of the invention. In accordance with an aspect of the present invention, each of the transformers 102 includes an additional 300 W common tap 110 having a circuit breaker or fuse (e.g., a 25 A circuit breaker 114 as shown). Thus, for example, a 300 W transformer 102-1 in accordance with the invention has two common terminals 109, 110 that total 600 W of power capacity. The additional common tap 110 allows an installer of landscape lighting to access power capacity that might otherwise be left unutilized. The advantages of this configuration will be explained in further detail hereinbelow. In accordance with another aspect of the invention, the primary winding 104 includes a primary circuit breaker or fuse 112 (e.g., a magnetic circuit breaker) to protect the entire transformer 102 from overloading. In the illustrative embodiments, the primary circuit breaker is configured to prevent drawing in excess of 300 W, 600 W, 900 W, 1200 W, or 1500 W of power on the secondary winding 108 of transformers 102-1 through 102-5, respectively.

Figure 2:
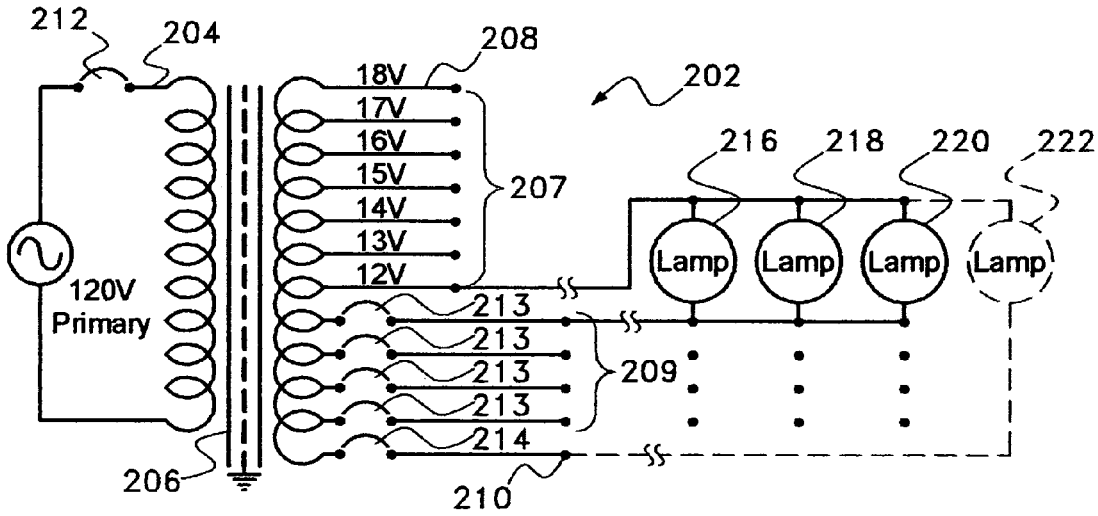
FIG. 2 is a schematic of a 1200 W landscape lighting transformer and an exemplary wiring run of landscape lighting in accordance with the present invention.

Referring now to FIG. 2, there is depicted an illustrative embodiment of a plurality of wire runs connecting landscape lighting lamps to a transformer in accordance with the present invention. The exemplary application shows how wire runs can be installed up to the full capacity of the transformer without overloading any of the common terminals. As depicted in the drawing, a 1200 W transformer 202 comprises a primary winding 204, core 206, and secondary winding or coil 208. The primary winding 204 is coupled to a 120V power source. The secondary winding 208 of transformer 202 has a plurality of standard output taps 207 coupled to the secondary winding 208, where each output tap 207 corresponds to a specified output voltage on the secondary winding ranging 208 from 18V to 12V. The transformer 202 further includes four 300 W common taps 209 (which total 1200 W) and an additional 300 W common tap 210. These output and common taps 207, 209, 210 are electrically coupled to the secondary winding 208 in a conventional fashion. The primary winding 204 is protected by a circuit breaker 212. Each common tap 109 is protected by a 25 A breaker 213.

In an exemplary application shown in FIG. 2, three (3) wire runs of lamps (e.g., 12-guage, 2 wire runs) 216, 218, 220, each having a 90 W lamp load at 12V are connected to the transformer 202. As will be explained in more detail below, each of the four common terminals 209 can be connected to three wire runs. As depicted in the drawing, wire runs and lamps 216, 218 and 220 are connected to the 12V terminal of the standard output taps 207, and each of the common taps 209. Note, the lamps are shown as being connected to only one of the common taps 209 for clarity; there are actually three wire runs connected to each of the four (4) common taps 209 that power a total of 12 lamps. In this example, each wire run/lamp draws 7.5 A (e.g., 7.5 A=90 W/12V). Thus, for three wire runs/lamps a total of 22.5 A or 270 W (e.g., 90 W×3=270 W) are drawn through each common tap 209. This leaves 2.5 A (e.g., 25 A–22.5 A=2.5 A) or 30 W (e.g., 300 W–270 W=30 W) of unused capacity on each common tap, for a total of 120 W (e.g., 4 common taps×30 W) of unused capacity. It is clear that a fourth wire run on any common tap 209 would exceed the available current draw on that tap (e.g., four wire runs at 12V will draw 360 W or 30 A (360 W/12V), which is in excess of the 300 W/25 A limit imposed by circuit breaker 213). Thus, it is apparent that in this example, 10% of the transformer's capacity is left unutilized. The additional common tap 210 enables the use of up to 120 W of power that would otherwise be left over in a standard 4-tap configuration. In this example, an additional wire run with a lamp 222 can be added by connecting this wire run to the additional common tap 210, which is protected by a 25 A breaker 214. This last wire run/lamp 222 draws 90 W, which is within the 120 W excess that is left over as described above. The primary breaker 212 prevents the overall capacity from exceeding the total output (here, 1200 W) of the transformer. Thus, by adding a "spare" common tap on the secondary winding and protecting the primary winding, a transformer in accordance with the present invention permits increased utilization of the transformer's power capacity in comparison to conventional low-voltage transformer designs. The invention enables an installer of landscape lighting to connect wire runs up to the full capacity of the transformer without overloading any of the common terminals. This provides the added advantage of using smaller rated transformers for applications where heretofore a larger unit may have been required due to the inability to access the full rated capacity of the unit.

The present invention has been shown and described in what are considered to be the most practical and preferred embodiments. It is anticipated, however, that departures may be made therefrom and that obvious modifications will be implemented by those skilled in the art. It will be appreciated that those skilled in the art will be able to devise numerous arrangements and variations which, although not explicitly shown or described herein, embody the principles of the invention and are within their spirit and scope.

I claim:

1. A transformer for low-voltage applications, comprising:

a primary winding and a secondary winding inductively coupled to the primary winding, the primary winding adapted to be energized with a high voltage and the secondary winding adapted to carry a proportionately lower voltage, the secondary winding including at least one output tap corresponding to a specified output voltage;

at least one common tap for each nW of output power up to the full capacity of the transformer, the secondary winding further including an additional common tap for an additional of nW of output power beyond the full capacity of the transformer;

means for breaking a circuit associated with the primary winding, wherein the means for breaking the circuit are adapted to break the circuit when the full capacity of the transformer is exceeded; and wherein each common tap and the additional common tap comprise a circuit breaker associated therewith.

2. The transformer recited in claim 1, wherein the means for breaking a circuit is a magnetic circuit breaker.

3. The transformer recited in claim 1, wherein the means for breaking a circuit is a thermal circuit breaker.

4. The transformer recited in claim 1, wherein the means for breaking a circuit is a fuse.

5. The transformer recited in claim 1, wherein n=300 such that at least one common tap is provided for each 300 W of output power and the total output power of the transformer is in multiples of 300 W.

6. The transformer recited in claim 5, wherein the means for breaking a circuit are magnetic circuit breakers.

7. The transformer recited in claim 5, wherein the means for breaking a circuit are thermal circuit breakers.

8. The transformer recited in claim 5, wherein the means for breaking a circuit are fuses.

9. The transformer recited in claim 1, further comprising a plurality of output taps corresponding to a series of output voltages.

10. A transformer for low-voltage applications, comprising:

a primary winding and a secondary winding inductively coupled to the primary winding, the primary winding adapted to be energized with a high voltage and the secondary winding adapted to carry a proportionately lower voltage, the secondary winding including a plurality of output taps, each output tap corresponding to a specified output voltage;

at least one common tap for each 300 W of output power up to the full capacity of the transformer, the secondary winding further including an additional common tap for an additional 300 W of output power beyond the full capacity of the transformer;

means for breaking a circuit associated with the primary winding, wherein the means for breaking the circuit are adapted to break the circuit when the full capacity of the transformer is exceeded; and wherein each common tap and the additional common tap comprise a circuit breaker associated therewith.

11. The transformer recited in claim 10, wherein each common tap and the additional common tap have means for breaking a circuit associated therewith.

12. The transformer recited in claim 10, wherein the means for breaking a circuit are magnetic circuit breakers.

13. The transformer recited in claim 10, wherein the means for breaking a circuit are thermal circuit breakers.

14. The transformer recited in claim 10, wherein the means for breaking a circuit are fuses.

15. A transformer for low-voltage applications, comprising: a primary winding and a secondary winding inductively coupled to the primary winding, the primary winding adapted to be energized with a high voltage and the secondary winding adapted to carry a proportionately lower voltage, the secondary winding including a plurality of output taps, each output tap corresponding to a specified output voltage, and at least one common tap for each 300 W of output power up to the full capacity of the transformer, the secondary winding further including an additional common tap for an additional 300 W of output power beyond the full capacity of the transformer; and a circuit breaker associated with the primary winding and a circuit breaker associated with each common tap and the additional common tap.

* * * * *